United States Patent [19]

Milnar

[11] 4,411,425

[45] Oct. 25, 1983

[54] BENCH PRESS SAFETY REST

[76] Inventor: James B. Milnar, 30255 Champine, St. Clair Shores, Mich. 48082

[21] Appl. No.: 326,115

[22] Filed: Nov. 30, 1981

Related U.S. Application Data

[63] Continuation of Ser. No. 98,113, Nov. 28, 1979, abandoned.

[51] Int. Cl.[3] ..... A63B 13/00

[52] U.S. Cl. ..... 272/123; 272/DIG. 4; 248/65

[58] Field of Search ..... 272/123, 122, 117, 134, 272/144, 93, 900; 248/65, 49

[56] References Cited

U.S. PATENT DOCUMENTS

| | | | |
|---|---|---|---|
| 4,205,838 | 6/1980 | McIntosh | 272/123 |
| 4,231,570 | 11/1980 | Reis | 272/123 |
| 4,302,009 | 11/1981 | Johnson | 272/123 |
| 4,316,609 | 2/1982 | Silerman | 272/123 |

OTHER PUBLICATIONS

"Extra-Heavy Squat Rack-Supine Press Bench Combination"-Marcy Catalogue, 1974, p. 45.

"Mark VI"-Marcy Catalogue, 1974, p. 47.

*Primary Examiner*—Richard C. Pinkham

*Assistant Examiner*—William R. Browne

*Attorney, Agent, or Firm*—Basile, Weintraub & Hanlon

[57] ABSTRACT

The bench press safety rest is essentially two adjustable bar supporting members attached symmetrically on each longer side of a weight lifting bench seat section. The attached adjustable bar supporting members should extend upwards and in position for the purpose of supporting a resting barbell immediately above the lower chest of differently sized persons when individually occupying the weight lifting bench for reclined arm press.

7 Claims, 3 Drawing Figures

1(b)
1(a)
1(c)
1(e)
1(d)
4(b)
4(b)
5
5
2
3
3
1(c)
1(d)

BENCH PRESS SAFETY REST

This application is a continuation, of application Ser. No. 098,113, filed Nov. 28, 1979 and since abandoned.

BACKGROUND OF THE INVENTION

1. Field of the Invention

This new device relates to a unique method of providing a mechanical substitute for the assistance of a "spotter" during an individual's performance of the bench press exercise.

2. Description of the Prior Art

It is important for a participant in regular bench press exercise to work out at or near his limit (i.e. the most weight that can be lifted ten times in repetition or the most weight lifted once or twice), always attempting to perform more repetitions or adding more weights. This results in the most progressive improvement in the strength of the particular muscle group involved. Consequently, regular bench pressing will impose episodes when one is stuck with a barbell on their chest because an attempt to increase performance failed. A stand-by spotter aids at this time. However, a spotter is not always available to the many people who, for one reason or another, perform the excerise alone or at least when a spotter is not at immediate stand-by attention, as is more safe.

Prior to this the only alternatives to a spotter provided in weight bench design included two lower hooks approximately located one foot above the weight bench seat, one attached to each main upright barbell support at the head of the bench. This supposedly enables a fatigued person doing the bench press excericse to, with what partial arm extension he can muster, pass the now too heavy barbell over his throat and face and onto the hooks in order to abandon the weight. This is plainly hazardous, especially when attempting one repetition with maximum weight.

The main object of this invention is to provide a simple mechanical substitute for a spotter, thereby allowing an individual to do the bench press alone with relatively greater safety and convenience.

Further, the device should serve as an easily installed accessory to, or integrated component of most weight lifting benches.

Still further, it should be easily adjustable to accommodate the range of older adolescent and adult sized persons who may use it, especially the vertical adjust of the adjustable bar supporting members, this being critical to the bench press safety rest method.

SUMMARY OF THE INVENTION

The bench press safety rest is a simple device that can be attached to most any of the variety of commercially or otherwise available weight lifting benches. Attachment of the bench press safety rest can be made permanent by welding or as an accessory by means of its included fastening hardware, and a wrench. This fastening hardware consists of four bolts that hand bend to fit around the different structural tubing used in weight benches. Test practice has shown that with proper installation and adjustment of the bench press safety rest upon a weight lifting bench, a prospective weight lifter can, after having exerted himself to disabling arm fatigue with a heavy barbell, maneuver the barbell with little difficulty onto the bench press safety rest and exit by sliding out from under the bar and off the bench.

BRIEF DESCRIPTION OF THE DRAWING

Other objects and advantages of this invention will become more apparent after a consideration of the specification with reference to the accompanying drawings, wherein.

DESCRIPTION OF THE PREFERRED EMBODIMENT

Figure 1:
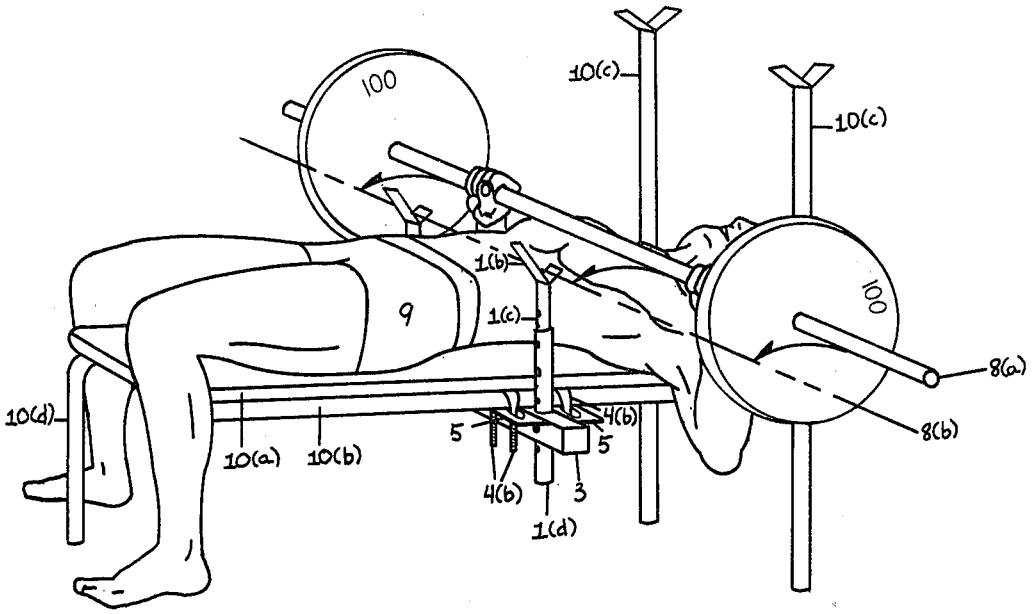
FIG. 1 is a side perspective view of the invention attached to an occupied weight lifting bench.
Figure 2:
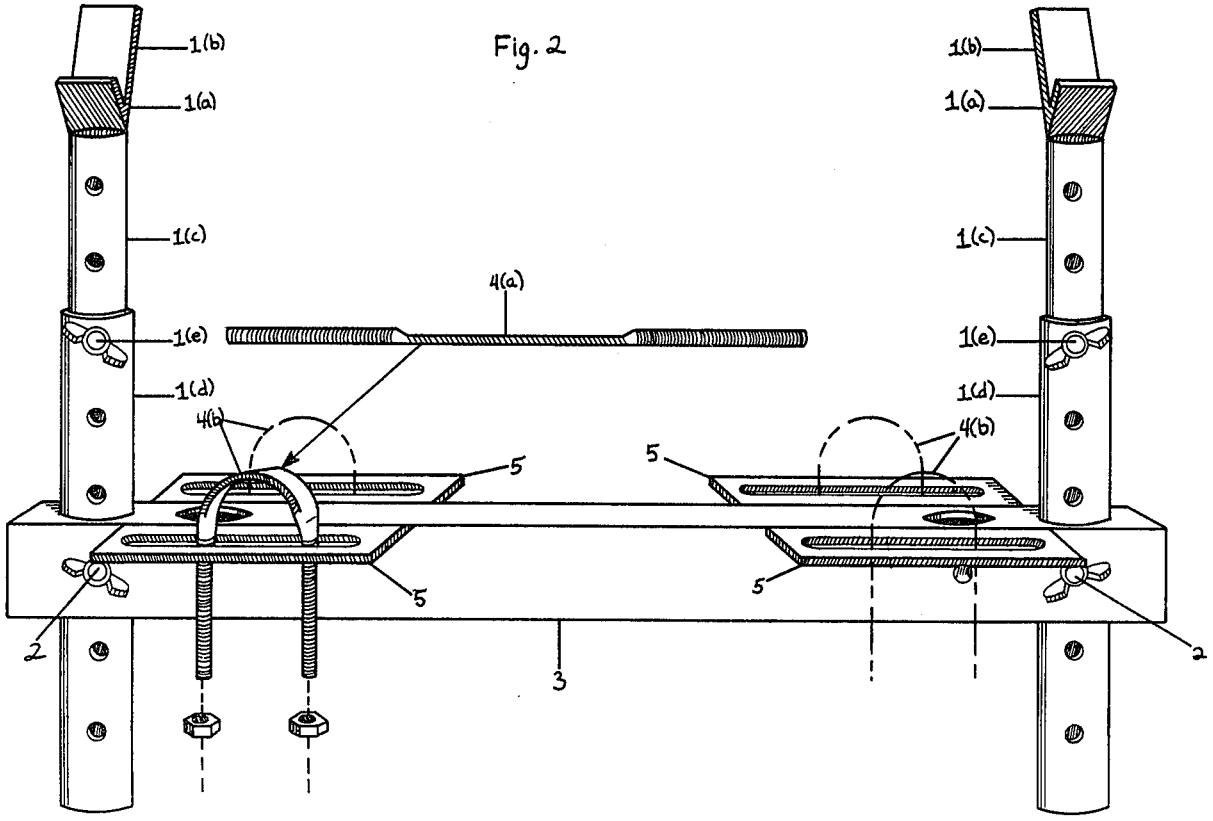
FIG. 2 is a front perspective view of the invention in elevation.
Figure 3:
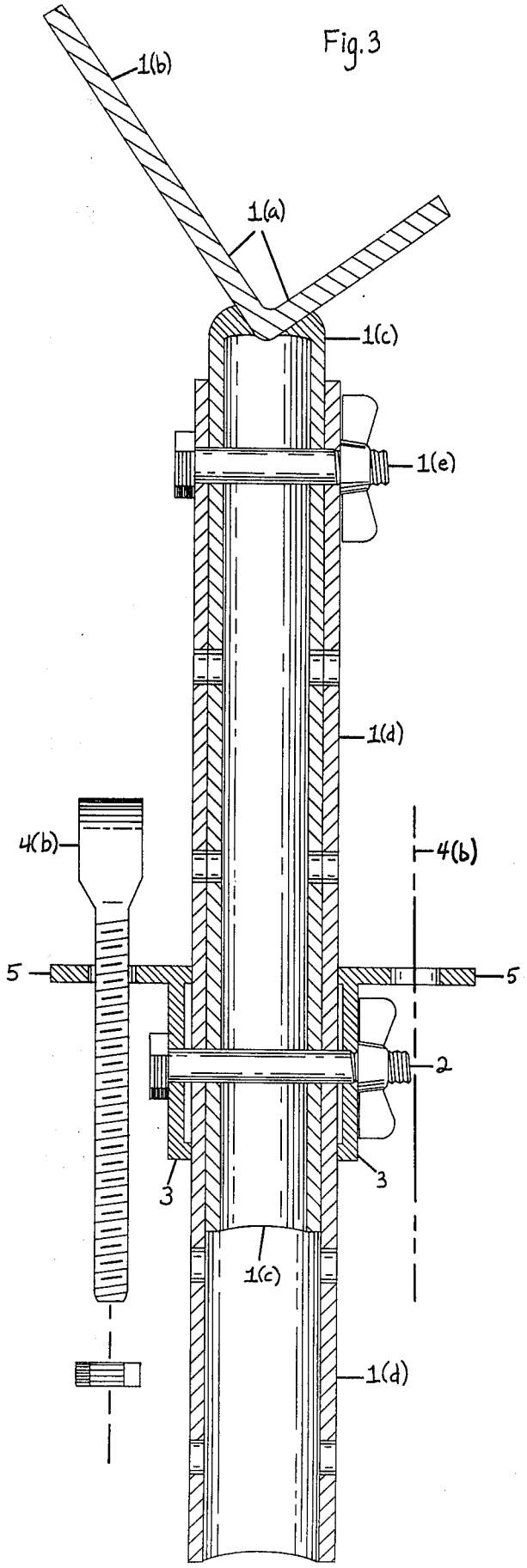
FIG. 3 is a vertical cutaway section view of the bench press safety rest.

Referring to the drawings of this invention, the bench press safety rest preferably of steel comprises a pair of adjustable bar supporting members 1 being securely attachable to the longer horizontal structural members 10(*b*) of the seat section 10(*a*) of most any of the variety of commercially or otherwise available weight lifting benches, including the most standard design weight lifting bench 10 shown with adjustable bar supporting members 1 attached. The adjustable bar supporting members 1 are attached in order to position said adjustable bar supporting members to extend upwards symmetrically on each longer side of the weight lifting bench seat section 10(*a*) for the purpose of supporting a resting barbell 8(*b*) immediately above the lower chest of differently sized persons i.e. one, 9 when individually occupying the weight lifting bench 10 for reclined arm press. Thus in the event that fatigue or insufficient strength disable the person's 9 full vertical arm extension in returning the barbell 8 back upon the main upright barbell supports 10(*c*), said person can with relative safety manage the barbell 8(*a*) to 8(*b*) on to the adjustable bar supporting members 1 alone and then slide out from under barbell 8(*b*).

The adjustable bar supporting members 1 are each adjustably secured as shown 2 at opposite ends of an intermediate horizontal member 3 so that each adjustable bar supporting member 1 is symmetrically parallel to the other end and perpendicular to the intermediate horizontal member 3. At the top of each adjustable bar supporting member 1 is a rest 1(*a*) of particular configuration whereby one arm 1(*b*) of each rest extends longer to prevent overshot when placing a bar across said rests. The intermediate horizontal member 3, which can be readily attached to a weight lifting bench 10 by means such as welding or other fastening methods, has included with it a set of four bolts 4 being threaded at each end, and 4 slotted brackets 5. Each of the bolts 4 has a flattened center and is sufficiently long to enable the bolts 4(*a*) to be bent 4(*b*) down and around most any of the different sizes of square or round steel tubing or steel angle commonly used in the longer horizontal structural members i.e. 10(*b*) of the seat section i.e. 10(*a*) of the variety of commercially or otherwise available weight lifting benches. Upon bending the four bolts 4 to fit the longer horizontal structural members i.e. 10(*b*) of a weight bench i.e. 10, the intermediate horizontal member i.e. 3 can be lifted under and up against the longer horizontal structural members i.e. 10(*b*) such that the ends of each of the four bolts 4(*b*) inserts through one of the slotted brackets 5 which are best welded to the intermediate horizontal member 3 as shown. Nuts are then tightened on to the bolts 4(*b*) to secure the intermediate horizontal member to the longer horizontal structural members.

Having thus described the invention, it is to be understood that certain modifications in the construction and arrangement of the parts thereof will be made as deemed necessary without departing from the scope of the appended claims.

What is claimed is:

1. A bench press safety rest for use with a weight lifting bench having a seat section with anterior and posterior ends and main barbell support members located immediately adjacent to said anterior end of the seat section, the improvement comprising:

first and second bar supporting members having a height substantially less than the height of the main barbell support members, said first and second bar supporting members being spaced a substantial distance along and toward said posterior end of said seat section from said main barbell support members for supporting a barbell immediately above the chest area of a person occupying a weight lifting bench; and means adapted for attaching said first and second bar supporting members to opposite sides of said seat section of the weight lifting bench said, attaching means including:

a horizontal member attachable to said seat section of said weight lifting bench; and means for attaching said first and second bar supporting members to said horizontal member such that said horizontal member supports said first and second bar supporting members along said seat section of said weight lifting bench.

2. The bench press safety rest as described in claim 1 further including means for adjustably fastening the horizontal member to the seat section of a weight lifting bench such that the position of said horizontal member can be varied along the length of said seat section with respect to the main barbell support members.

3. The bench press safety rest as described in claim 2 wherein the fastening means includes:

a plurality of threaded fasteners, said threaded fasteners being extendable around the horizontal member and a portion of the seat section of the weight lifting bench to adjustably fasten said horizontal member to said seat section of said weight lifting bench.

4. The bench press safety rest as described in claim 1 wherein the first and second bar supporting members each have a rest affixed to the top end thereof, said rest being formed with first and second spaced arms, with one of said arms being of longer length.

5. The bench press safety rest as defined in claim 1 wherein the first and second bar supporting members further include means for vertically adjusting the height of said first and second bar supporting members.

6. The bench press safety rest as defined in claim 5 wherein the adjusting means includes:

the first and second bar supporting members each being comprised of first and second telescopingly engagable members; and fastening means for securing said first and second members in one of a plurality of vertically extendable positions.

7. In combination a weight lifting bench and a bench press safety rest;

said weight lifting bench having a seat section with anterior and posterior ends;

main barbell support members located immediately adjacent said anterior end of said seat section of said weight lifting bench; and first and second bar supporting members having a height substantially less than the height of said main barbell support members, said first and second barbell supporting members being attached to said seat section of said weight lifting bench on opposite sides thereof and spaced a substantial distance along and toward the posterior end of said seat section from said main barbell support members for supporting a barbell immediately over the chest area of a person occupying said weight lifting bench.

* * * * *